US005799363A

United States Patent [19]

Inoue et al.

[11] Patent Number: 5,799,363

[45] Date of Patent: Sep. 1, 1998

[54] UPRIGHT VACUUM CLEANER

[75] Inventors: Takayuki Inoue, Kawanishi; Masami Fukumoto, Ikeda; Izumi Yamaura, Kawanishi, all of Japan

[73] Assignee: Matsushita Electric Industrial Co., Ltd., Osaka-fu, Japan

[21] Appl. No.: 781,113

[22] Filed: Jan. 9, 1997

Related U.S. Application Data

[62] Division of Ser. No. 388,734, Feb. 14, 1995, abandoned.

[30] Foreign Application Priority Data

Feb. 16, 1994 [JP] Japan ..... 6-019336

[51] Int. Cl.[6] ..... A47L 7/04

[52] U.S. Cl. ..... 15/327.3; 15/339

[58] Field of Search ..... 15/350, 327.3, 15/339

[56] References Cited

U.S. PATENT DOCUMENTS

| | | | |
|---|---|---|---|
| 3,283,355 | 11/1966 | Jepson | 15/327.3 |
| 4,571,849 | 2/1986 | Gardner et al. | 15/327.3 X |
| 5,210,996 | 5/1993 | Fassauer | 15/327.3 X |
| 5,392,492 | 2/1995 | Fassauer | 15/327.3 |

FOREIGN PATENT DOCUMENTS

| | | |
|---|---|---|
| 2 148 345 | 3/1973 | France . |
| 2 455 878 | 12/1980 | France . |
| 2 596 636 | 10/1987 | France . |
| 1 628 776 | 6/1971 | Germany . |
| 51-29356 | 8/1976 | Japan . |
| 56-14543 | 2/1981 | Japan . |
| 63-154140 | 6/1988 | Japan . |
| 63-154141 | 6/1988 | Japan . |
| 63-154142 | 6/1988 | Japan . |
| 63-189151 | 12/1988 | Japan . |
| 4 058 921 | 2/1992 | Japan . |
| 4 193 239 | 7/1992 | Japan . |
| 4-319321 | 11/1992 | Japan . |
| 4-341229 | 11/1992 | Japan . |
| 5-84172 | 4/1993 | Japan . |
| 6-133900 | 5/1994 | Japan . |
| 6-169863 | 6/1994 | Japan . |
| 6-327589 | 11/1994 | Japan . |
| 165 801 | 12/1933 | Switzerland . |
| 116 431 | 6/1918 | United Kingdom . |
| 947 380 | 1/1964 | United Kingdom . |

*Primary Examiner*—Chris K. Moore

*Attorney, Agent, or Firm*—Panitch Schwarze Jacobs & Nadel, P.C.

[57] ABSTRACT

An upright vacuum cleaner has a float unit (29A) for lifting the upright vacuum cleaner during cleaning by spouting discharge air to a floor to be cleaned. The float unit (29A) has a floor-opposing face having a discharge-air outlet port (31) for spouting the discharge air of a motor fan (21).

3 Claims, 21 Drawing Sheets

UPRIGHT VACUUM CLEANER

This application is a division of application Ser. No. 08/388,734, filed Feb. 14, 1995, and now abandoned.

FIELD OF THE INVENTION AND RELATED ART STATEMENT

1. Field of the Invention

The present invention relates generally to an upright vacuum cleaner, which is suitable for the general user.

2. Description of the Related Art

FIG. 21 is a perspective view showing a conventional upright vacuum cleaner. As shown in FIG. 21, the conventional upright vacuum cleaner comprises a vacuum cleaner main body 3 and a floor nozzle 2, which is arranged under the vacuum cleaner main body 3. A dust collection chamber 4 in the vacuum cleaner main body 3 is connected through a hose 1 to an inlet port disposed at the bottom face of the floor nozzle 2. The vacuum cleaner main body 3 has a motor fan 8 for generating a suction force. Dust on a floor is drawn by the suction force of the motor fan 8 to the dust-collection chamber 4 through the inlet port and the hose 1. The vacuum cleaner main body 3 also has a cord for providing electric power to the motor fan 8, and a cord adjusting reel 6 for winding the cord.

Since the conventional upright vacuum cleaner has the heavy motor fan 8 and a large dust-collection chamber 4, the vacuum cleaner main body 3 is configured to have a heavy-weight and a large-size. In case of cleaning the floor by moving the floor nozzle 2, the conventional upright vacuum cleaner is difficult to move laterally in a cleaning operation or a handling. Even though a user wants to move the floor nozzle 2 laterally (i.e., leftward or rightward) as shown by an arrow A in FIG. 21, the vacuum cleaner main body 3 is generally moved only back and forth as shown by an arrow B in FIG. 21, because the conventional upright vacuum cleaner is guided by one or two rollers for slidably holding the vacuum cleaner main body containing the motor fan therein. In such back to forth operations of the floor nozzle 2, the conventional upright vacuum cleaner was moved sideways little by little. Therefore, there has been a demand to freely move the rather heavy vacuum cleaner main body laterally the floor nozzle 2 on the floor to be cleaned.

OBJECT AND SUMMARY OF THE INVENTION

The object of the present invention is to provide an upright vacuum cleaner which has remarkably improved handling or movability.

In order to achieve the above-mentioned object, an upright vacuum cleaner in accordance with the present invention comprises:

- a main body having a motor fan for generating suction force, and a dust-collection chamber for collecting dust,
- a floor nozzle unit, which is disposed under the main body, and has an inlet port for attracting dust on a floor into the dust-collection chamber by the suction force of the motor fan,
- a grip handle for moving the upright vacuum cleaner, and
- a float unit, which has a floor-opposing face where an outlet port is formed for spouting air to the floor from the motor fan, and a float face is formed around the outlet port.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

[First embodiment]

Figure 1:
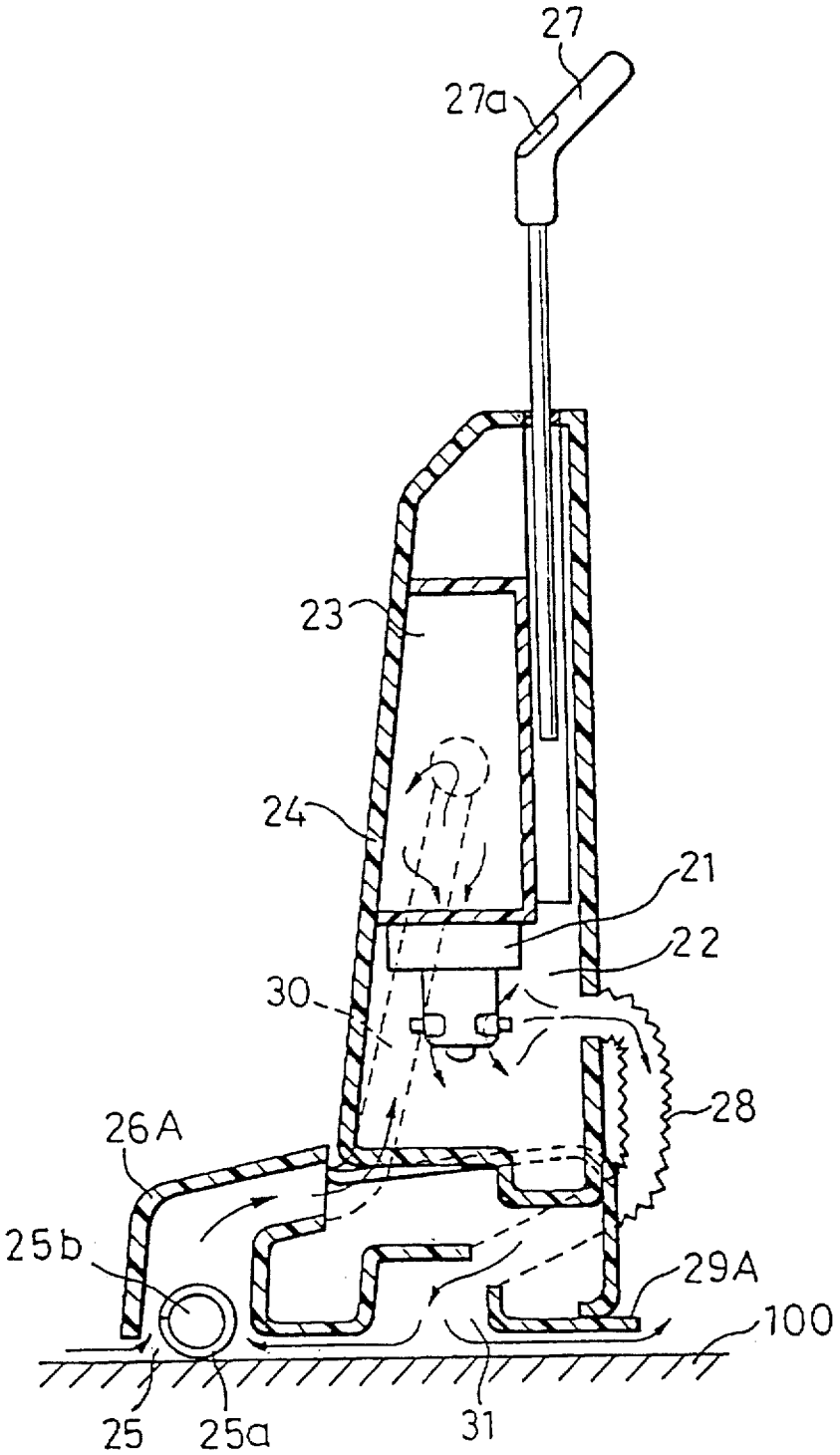
FIG. 1 is a sectional side view of a first embodiment of the upright vacuum cleaner in accordance with the present invention.
Figure 2:
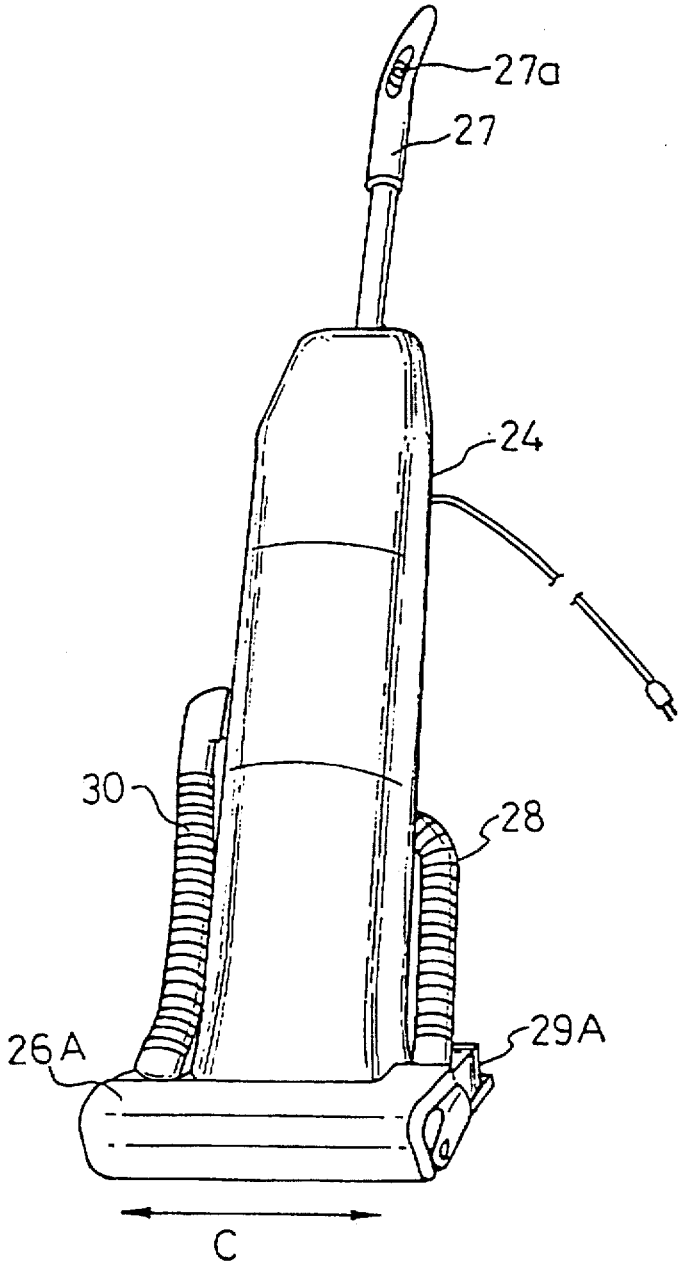
FIG. 2 is a perspective view of the first embodiment of the upright vacuum cleaner of FIG. 1.
Figure 3A:
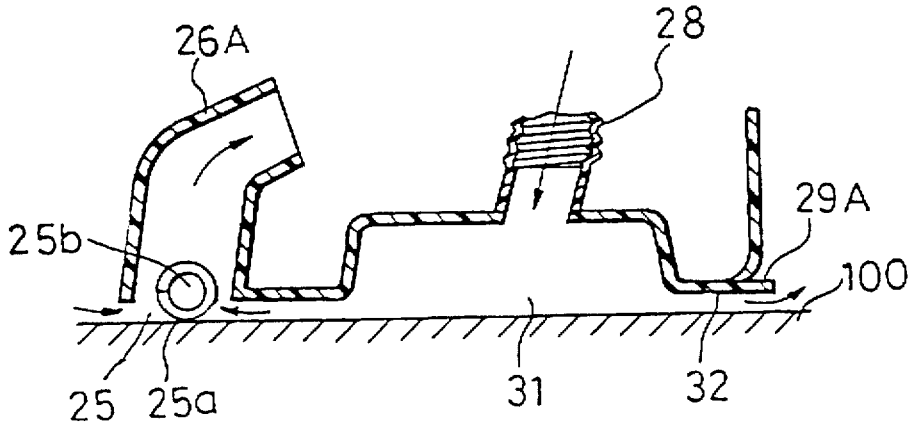
FIG. 3A is a sectional side view showing a part of the first embodiment of the upright vacuum cleaner of FIG. 1.
Figure 3B:
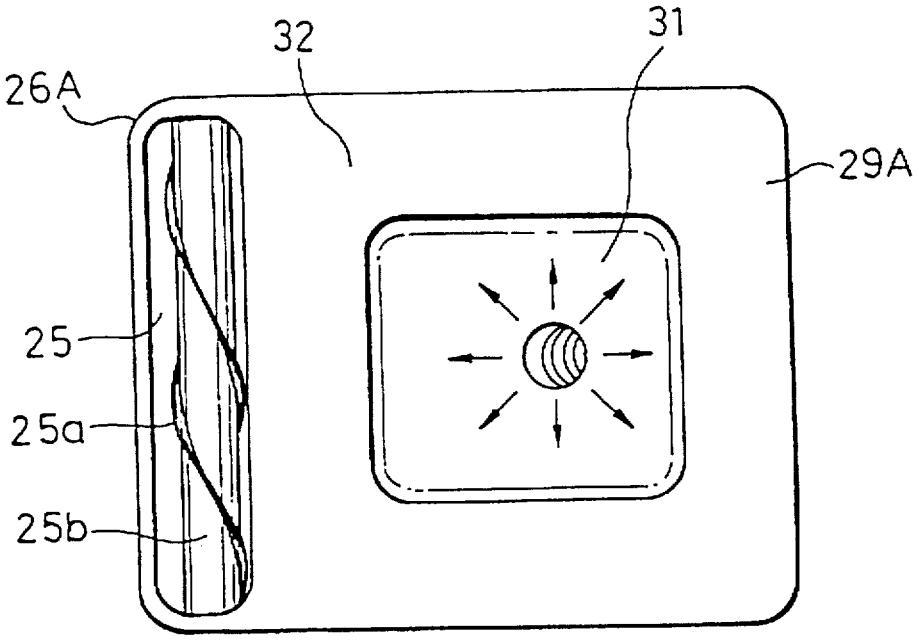
FIG. 3B is a bottom view showing a floor nozzle unit of the first embodiment of the upright vacuum cleaner of FIG. 1.

Hereafter, an upright vacuum cleaner in accordance with a first embodiment of the present invention will be described with reference to FIGS. 1, 2, 3A and 3B. FIG. 1 shows a sectional side view of a first embodiment of the upright vacuum cleaner in accordance with the present invention. FIG. 2 shows a perspective view of the first embodiment of the upright vacuum cleaner of FIG. 1. FIG. 3A shows a sectional side view showing a floor nozzle unit 26A of the upright vacuum cleaner of FIG. 1. FIG. 3B shows a bottom view showing the floor nozzle unit 26A of the upright vacuum cleaner of FIG. 1.

The upright vacuum cleaner of the first embodiment comprises a main body 24 and the floor nozzle unit 26A. The main body 24 has a motor fan chamber 22 receiving a motor fan 21 for generating suction force, and a dust-collection chamber 23 for accumulating the collected dust. The floor nozzle unit 26A having an inlet port 25 on a bottom face is provided under the main body 24, and the main body 24 is rotatably connected to the floor nozzle unit 26A so as to be raised from a floor 100. A rotation brush 25*a* arranged in the inlet port 25 is rotated by a motor (not shown) during cleaning. The rotation brush 25*a* comprises a rotation drum 25*b* having a helical fin made of an elastic material, such as rubber, or a helical brush for sweeping or brushing a carpet on the floor 100. A handle grip 27 for operating or handling the upright vacuum cleaner is provided on the uppermost position of the main body 24, that is, at the position opposite to the floor nozzle unit 26A with regard to the main body 24.

As shown in FIG. 1, the floor nozzle unit 26A has a float plate 29A, which is provided on a lower face of the floor nozzle unit 26A, namely, on a floor-opposing face of the floor nozzle unit 26A. The float plate 29A is arranged behind the inlet port 25. A discharge-air outlet port 31 for discharging air is formed at a center portion of the float plate 29A. The discharge-air outlet port 31 is connected to the motor fan chamber 22 through the discharge hose (discharge air-path) 28, so as to discharge air in the motor fan chamber 22 from the discharge-air outlet port 31. The inlet port 25 of the floor nozzle unit 26A is connected to the dust-collection chamber 23 through an intake hose 30.

Operation of the above-mentioned first embodiment Is elucidated hereafter.

When an operation switch 27*a* provided on the handle grip 27 is closed, and the motor fan 21 starts to rotate, suction air is generated in the inlet port 25 and discharge air is passed to the discharge-air outlet port 31 through the dust-collection chamber 23 and the motor fan chamber 22 as shown with arrows in FIG. 1. The generated discharge air is guided to flow between the float plate 29A and the floor 100 to be cleaned. As a result, the upright vacuum cleaner of the first embodiment is levitated from the floor 100. And, the upright vacuum cleaner can be easily and lightly operated and handled to move the floor nozzle unit 26A while cleaning.

In the upright vacuum cleaner of the first embodiment, the discharged air from the motor fan 21 is spouted from the discharge-air outlet port 31 through the discharge hose 28, as shown with arrows in FIGS. 3A and 3B. The float plate 29A has a float flat-face 32, which is constructed flat with regard to the part around the discharge-air outlet port 31. The discharge air spouted from of the discharge-air outlet port 31 flows to spread along the float flat-face 32 around the discharge-air outlet port 31. In other words, a layer of air flow is formed between the float flat-face 32 of the floor nozzle unit 26A and the floor 100 because of the pressure of the discharge air during spouting. As a result, the upright vacuum cleaner of the first embodiment is lifted from the floor 100 during cleaning. And, the frictional resistance between the floor nozzle unit 26A and the floor 100 is reduced to be extremely small or almost zero.

According to the first embodiment of the present invention, the upright vacuum cleaner can be easily moved on the floor as shown with the arrow C in FIG. 2, and can be lightly moved on the floor 100 by hand.

Since the float flat-face 32 is arranged around the discharge-air outlet port 31, the float flat-face 32 functions to stably hold the upright vacuum cleaner lifted by generating uniform air-flow in all directions from the discharge-air outlet port 31.

[Second embodiment]

Figure 4:
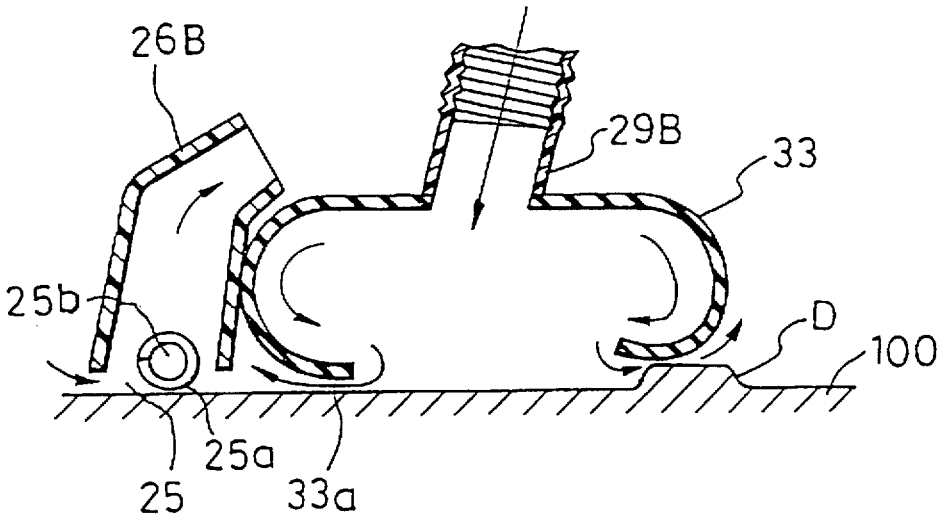
FIG. 4 is a sectional side view showing a part of a second embodiment of the upright vacuum cleaner in accordance with the present invention.

A second embodiment of the present invention is described with reference to FIG. 4. FIG. 4 shows a sectional side view of a floor nozzle unit 26B of the second embodiment of the upright vacuum cleaner.

Corresponding parts and components to the first embodiment are shown by the same numerals and marks, and the description thereof made in the first embodiment similarly applies. Differences and features of this second embodiment from the first embodiment are as follows.

In the second embodiment, the floor nozzle unit 26B has flexible skirt 33 instead of the float plate 29A in the first embodiment. The flexible skirt 33 is made of elastic material, such as butyl rubber having a thickness of 0.5 mm, and has flexible configuration as shown in FIG. 4.

The above-mentioned upright vacuum cleaner of the second embodiment can be easily and lightly moved on the floor 100 even if the floor 100 has a projection D as shown in FIG. A. Since the flexible skirt 33 of butyl rubber is an elastic material, it is filled out with the discharge air in the cleaning operation, a float flat-face 33*a* is formed to produce a layer of the air flow between the floor 100 and the bottom face of the flexible skirt 33. In case of cleaning the floor 100 having an uneven surface, since the flexible skirt 33 is transformed to fit to the uneven surface of the floor 100, the upright vacuum cleaner can keep to produce stably the float force for lifting the upright vacuum cleaner. Therefore, the upright vacuum cleaner of the second embodiment can produce a constant float force without deflating even if the floor 100 to be cleaned has a slope or an uneven surface. And, in case of cleaning such floor 100, the upright vacuum cleaner of the second embodiment can be easily and lightly operated by a user.

Apart from the above-mentioned second embodiment wherein the flexible skirt 33 as the float plate is made of elastic material, a modified embodiment may be such that only at least a lower portion of a flexible skirt, namely a contact portion to the floor 100, is made of elastic material, such as butyl rubber.

Apart from the above-mentioned second embodiment wherein the flexible skirt 33 is configured to have a round shape as shown in FIG. 4, a modified embodiment may be such that the flexible skirt is-configured to have a rectangular shape as shown in FIG. 1.

And apart from the above-mentioned second embodiment wherein the flexible skirt 33 and the inlet port 25 are provided in the floor nozzle unit 26B as one body, a modified embodiment may be such that the flexible skirt is arranged under the main body of the upright vacuum cleaner, and the floor nozzle unit having only inlet port is arranged in front of the flexible skirt. In this embodiment, the frictional resistance between the floor and the floor nozzle unit can be reduced to be extremely small or substantially zero.

[Third embodiment]

Figure 5A:
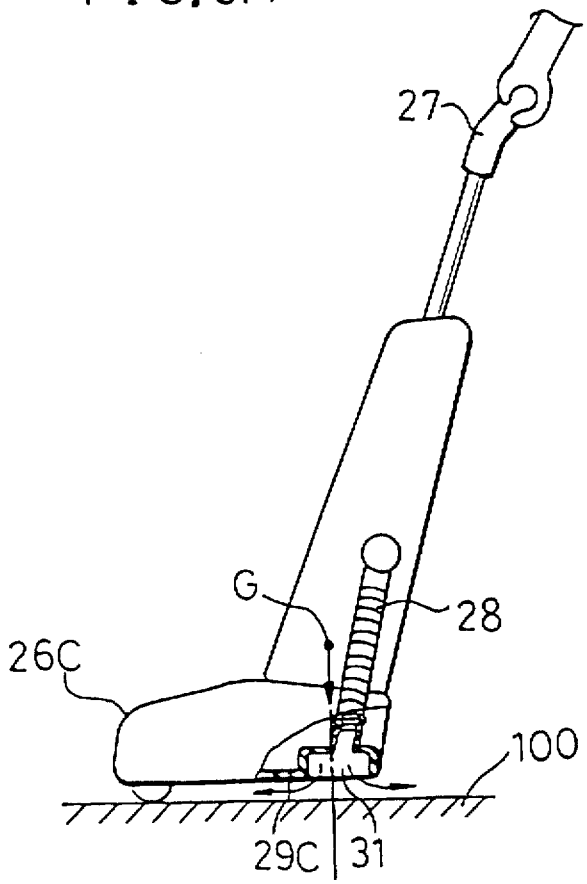
FIG. 5A is a side view showing a third embodiment of the upright vacuum cleaner in accordance with the present invention.
Figure 5B:
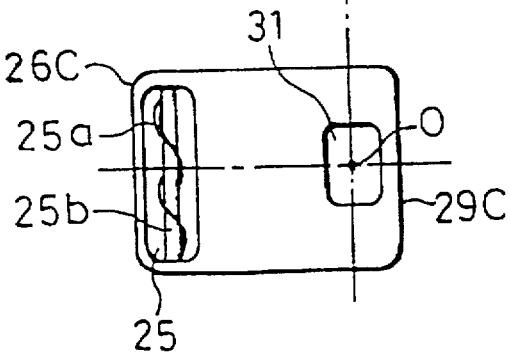
FIG. 5B is a bottom view showing a floor nozzle unit of the third embodiment of the upright vacuum cleaner of FIG. 5A.

A third embodiment of the present invention is described with reference to FIGS. 5A and 5B. FIG. 5A shows a side view of the upright vacuum cleaner of the third embodiment. FIG. 5B shows a bottom view of a floor nozzle unit 26*c* of the upright vacuum cleaner of FIG. 5A.

Corresponding parts and components to the first embodiment are shown by the same numerals and marks, and the description thereof made in the first embodiment similarly applies. Differences and features of this third embodiment from the first embodiment are as follows.

A float plate 29C of the floor nozzle unit 26C is arranged such that in the plan view arrangement the center position 0 of a discharge-air outlet port 31 is disposed on the vertical line passing through the center of gravity G of the upright vacuum cleaner in a cleaning posture. In other words, the discharge-air outlet port 31 is formed in the float plate 29C such that a vertical line passing the center point of the discharge force in plan view (FIG. 5B) of the discharge air from the discharge-air outlet port 31 and a vertical line passing the center of gravity G of the upright vacuum cleaner substantially agree with each other during cleaning.

As mentioned above, the discharge-air outlet port 31 of the float plate 29C is arranged in the center of gravity of the upright vacuum cleaner in plan view relation. And, the upright vacuum cleaner of the third embodiment is designed to balance between the float force and the weight of the upright vacuum cleaner.

The above-mentioned upright vacuum cleaner of the third embodiment can be smoothly and lightly moved in any directions on the floor 100.

Apart from the above-mentioned third embodiment wherein the discharge-air outlet port 31 is arranged such that a vertical line passing through the center point of the discharge force in the plan view and a vertical line passing through the center of gravity of the upright vacuum cleaner substantially agree with each other during cleaning, a modified embodiment may be such that the discharge-air outlet port is arranged such that a vertical line passing through the substantially center position of the discharge-air outlet port 31 and a vertical line passing through the center of gravity of the upright vacuum cleaner substantially agree with each other.

[Fourth embodiment]

Figure 6:
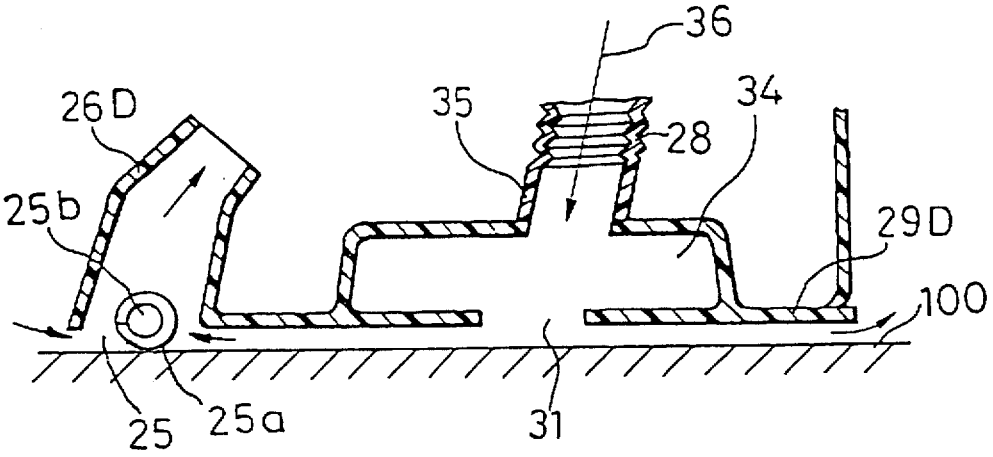
FIG. 6 is a sectional side view showing a part of a fourth embodiment in accordance with present invention.

A fourth embodiment of the present invention is described with reference to FIG. 6. FIG. 6 shows a sectional side view of a floor nozzle unit 26D of an upright vacuum cleaner of the fourth embodiment.

Corresponding parts and components to the first embodiment are shown by the same numerals and marks, and the description thereof made in the first embodiment similarly applies. Differences and features of this fourth embodiment from the first embodiment are as follows.

In FIG. 6, discharge air 36 from a motor fan chamber flows into an air chamber 34 through a discharge air passage 35, such as a discharge-air hose 28. The air chamber 34 is disposed at an outlet port side of the discharge-air passage 35.

The discharge-air passage 35 is connected between the motor fan chamber and the air chamber 34, so as to spout the discharge air 36 from a discharge-air outlet port 31. The discharge air 36 of the motor fan chamber is spouted from the discharge-air outlet port 31 to the floor 100 through the discharge-air passage 35 and the air chamber 34. The air chamber 34 is provided for reducing pressure fluctuation of the discharge air 36, and for producing discharge air 36 at a substantially constant pressure and flow.

According to the above-mentioned fourth embodiment, since the discharge air 36 spouted from the discharge-air outlet port 31 has a constant air-flow rate, the upright vacuum cleaner is kept in a stable floating state by a constant float force of the discharge air 36 from the discharge-air outlet port 31 of the float plate 29D. As a result, the upright vacuum cleaner of the fourth embodiment can be easily and smoothly operated in any direction.

[Fifth embodiment]

Figure 7:
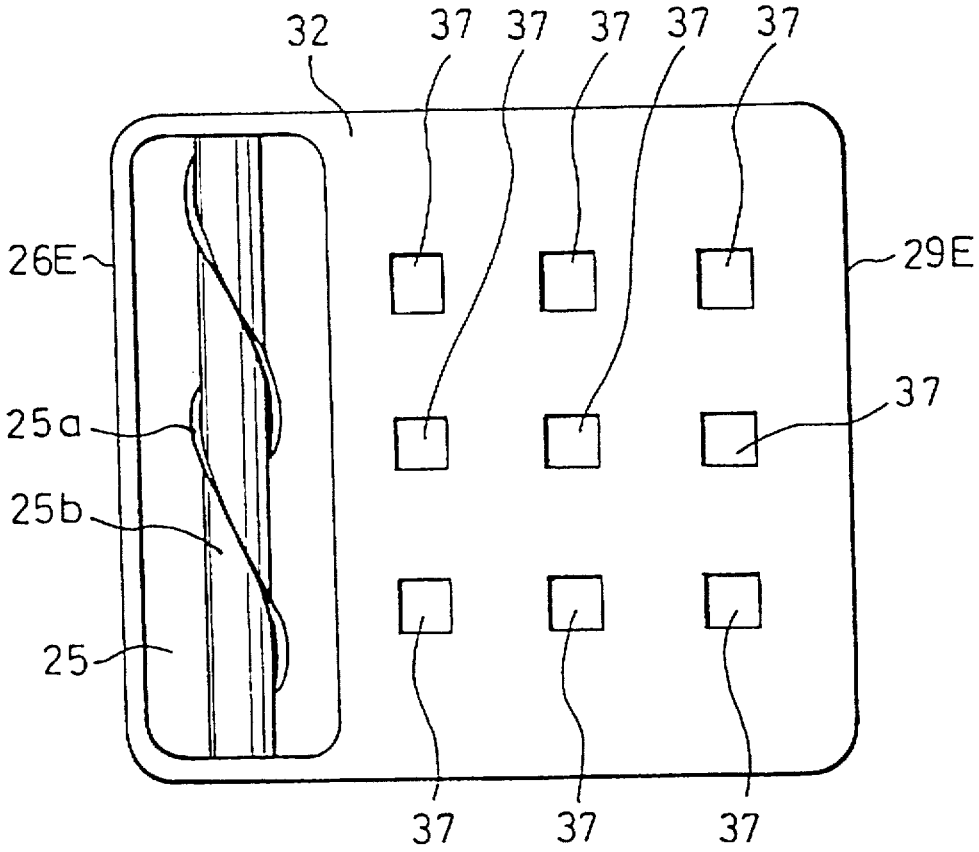
FIG. 7 is a bottom view showing a floor nozzle unit of a fifth embodiment of the upright vacuum cleaner in accordance with the present invention.

A fifth embodiment of the present invention is described with reference to FIG. 7. FIG. 7 shows a bottom view of a float plate 32 of an upright vacuum cleaner of the fifth embodiment.

Corresponding parts and components to the first embodiment are shown by the same numerals and marks, and the description thereof made in the first embodiment similarly applies. Differences and features of this fifth embodiment from the first embodiment are as follows.

As shown in FIG. 7, the float plate 32 of the floor nozzle unit 26E has plural outlet ports 37 for spouting the discharge air to the floor. Since these outlet ports 37 are connected to an air chamber as in the aforementioned fourth embodiment shown in FIG. 6, the pressure of the discharge air at each of outlet ports 37 is approximately the same relative to each other.

In the above-mentioned fifth embodiment, since the floor nozzle unit 26E has plural outlet ports 37 in the float plate 29E, some of these outlet ports 37 spout the discharge air to produce the float force for lifting the upright vacuum cleaner even if the floor to be cleaned has uneven surfaces or steps. Therefore, the upright vacuum cleaner of the fifth embodiment can be easily and smoothly moved during cleaning the floor having uneven surfaces or steps.

[Sixth embodiment]

Figure 8:
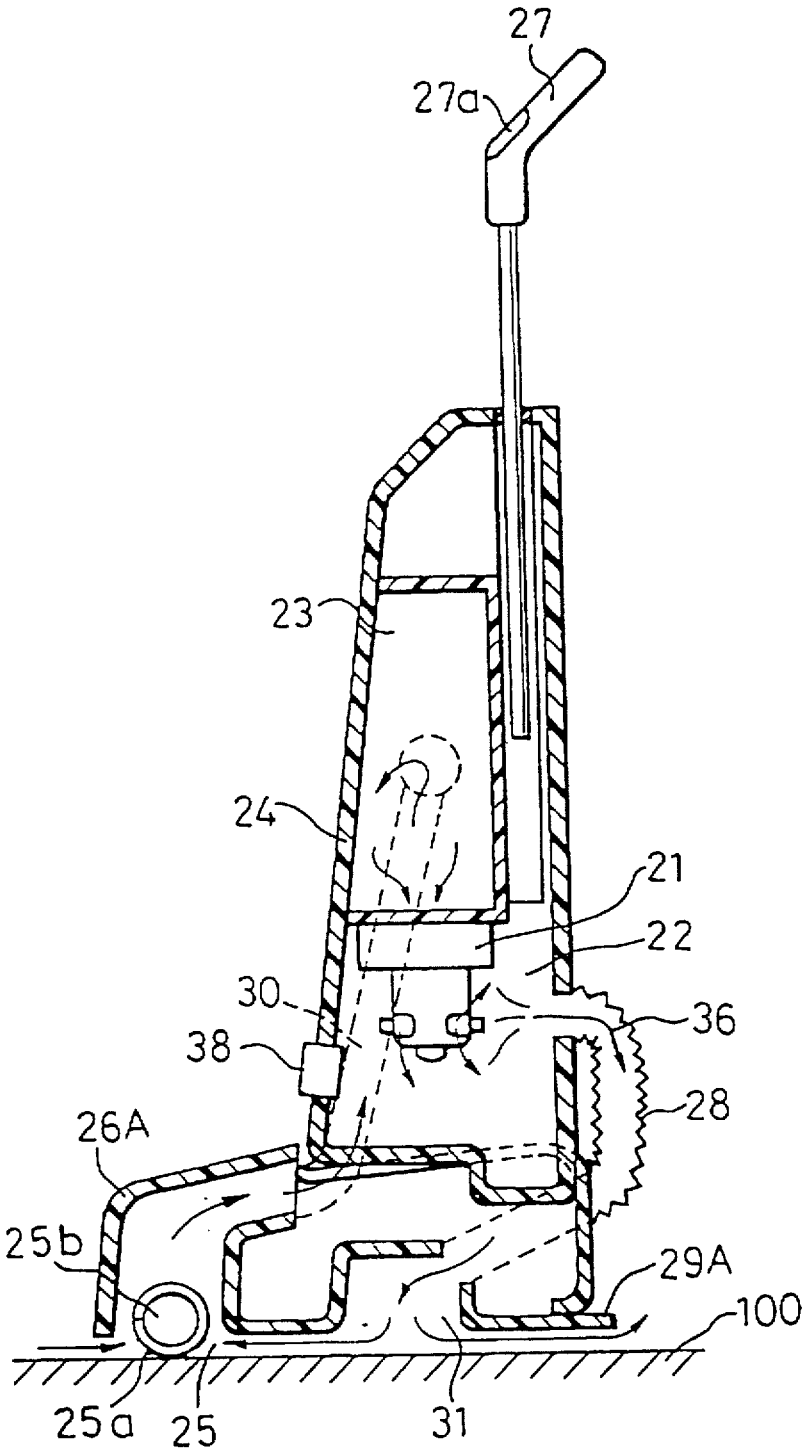
FIG. 8 is a sectional side view showing a sixth embodiment of the upright vacuum cleaner in accordance with the present invention.
Figure 9:
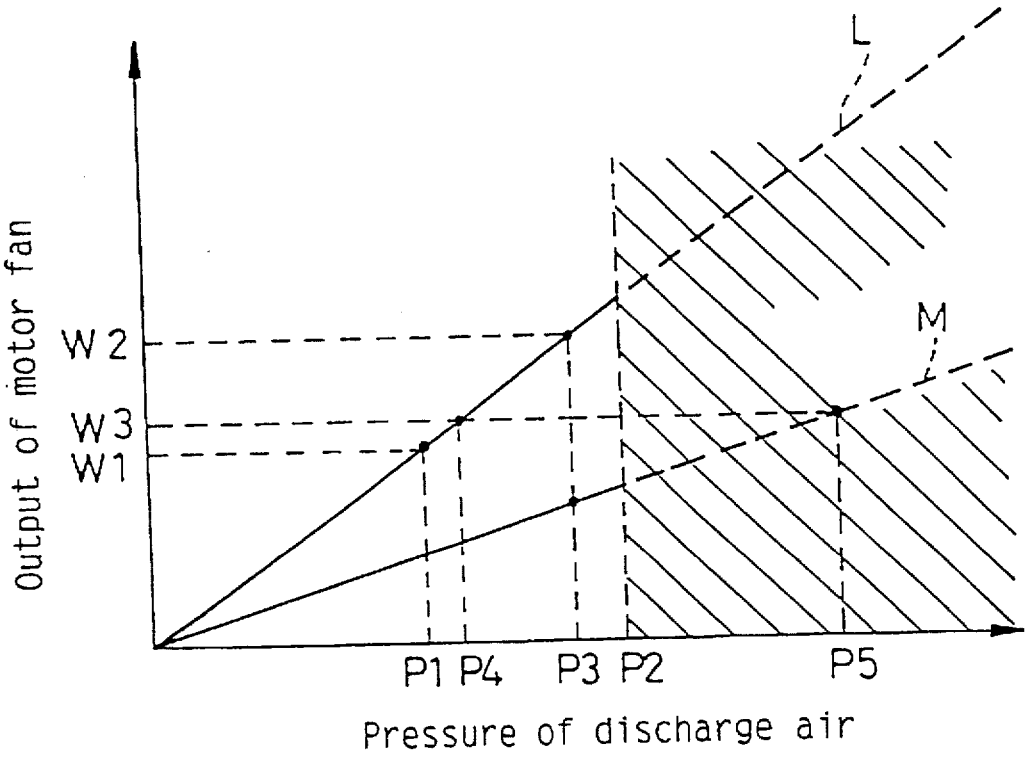
FIG. 9 is a graph showing a relation between output of a motor fan and pressure of discharged air.

A sixth embodiment of the present invention is described with reference to FIGS. 8 and 9. FIG. 8 shows a sectional side view of an upright vacuum cleaner of the sixth embodiment. FIG. 9 shows a graph showing a relation between output of a motor fan 21 and pressure of discharge air 36 of the motor fan 21.

Corresponding parts and components to the first embodiment are shown by the same numerals and marks, and the description thereon made in the first embodiment similarly applies. Differences and features of this sixth embodiment from the first embodiment are as follows.

The upright vacuum cleaner of the sixth embodiment has a pressure-regulating valve 38, which is provided to face a motor fan chamber 22 in a main body 24. The pressure-regulating valve 38 is provided for controlling the pressure of the discharge air 36 so as to keep under the predetermined safe pressure.

Operation of the above-mentioned sixth embodiment is elucidated with reference to FIG. 9 hereafter.

FIG. 9 shows a relationship between the pressure (abscissa) of the discharge air 36 and the output (ordinate) of the motor fan 21. In FIG. 9, lines L and M show two varieties of the floors in relationship to the pressure of the discharge air 36 and the output of the motor fan 21. The line L shows the case of a carpet, and the line M shows the case of a flooring or a tatami mat. The float force is in proportion to the pressure of the discharge air 36 because of different airtightness between the floor and the floor nozzle unit 26A. Therefore, the float force in case of the flooring etc. is larger than the float force in case of the carpet. A shaded portion in FIG. 9 shows an intense vibration area. In the intense vibration area, the float plate 29A of the upright vacuum cleaner is intensely vibrated owing to a poor balance between the weight of the upright vacuum cleaner and too high-pressure of the discharge air 36.

In FIG. 9, a first pressure P1 is a necessary minimum pressure for cleaning the carpet by handling lightly and smoothly. A second pressure P2 is a minimum pressure at the boundary of the intense vibration area. A third pressure P3 shows a setting value when the pressure regulating valve 38 starts to work, and the pressure of the discharge air 36 is kept at the third pressure P3 or less.

The output of the motor fan 21 is set in a range between a first output W1 and a second output W2 in order to prevent the vibration of the float plate 29A. The motor fan 21 used in the upright vacuum cleaner of the sixth embodiment is designed to meet the above-mentioned requirements, for example, to have a third output W3 between the first output W1 and the second output W2 as shown in graph of FIG. 9. In this case, the discharge air 36 in case of cleaning the carpet (shown by line L) is spouted at a fourth pressure P4. In the above-mentioned case, when the flooring (shown by line M) is cleaned by using this upright vacuum cleaner having the third output W3, the discharge air 36 may be a fifth pressure P5 if the pressure-regulating valve 38 is not provided in this upright vacuum cleaner, and thereby the upright vacuum cleaner is in the intense vibration area. However, the upright vacuum cleaner of the sixth embodiment is kept at the third pressure P3 or less because the pressure regulating valve 38 is provided for controlling at the third pressure P3 or less. Therefore, the vibration of the float plate 29A in the floor nozzle unit 26A the sixth embodiment due to the high-pressure of the discharge air is prevented.

As mentioned above, the upright vacuum cleaner of the sixth embodiment can be lightly moved for any kinds of floors, such as a carpet or flooring etc., and can be quietly operated because noise of the vibration owing to the discharge air is eliminated.

According to the sixth embodiment of the present invention, since the motor fan 21 is operated at a constant output for any kinds of floors, the upright vacuum cleaner of the sixth embodiment can be operated with necessary dust-collecting power for cleaning any type of the floor.

[Seventh embodiment]

Figure 10:
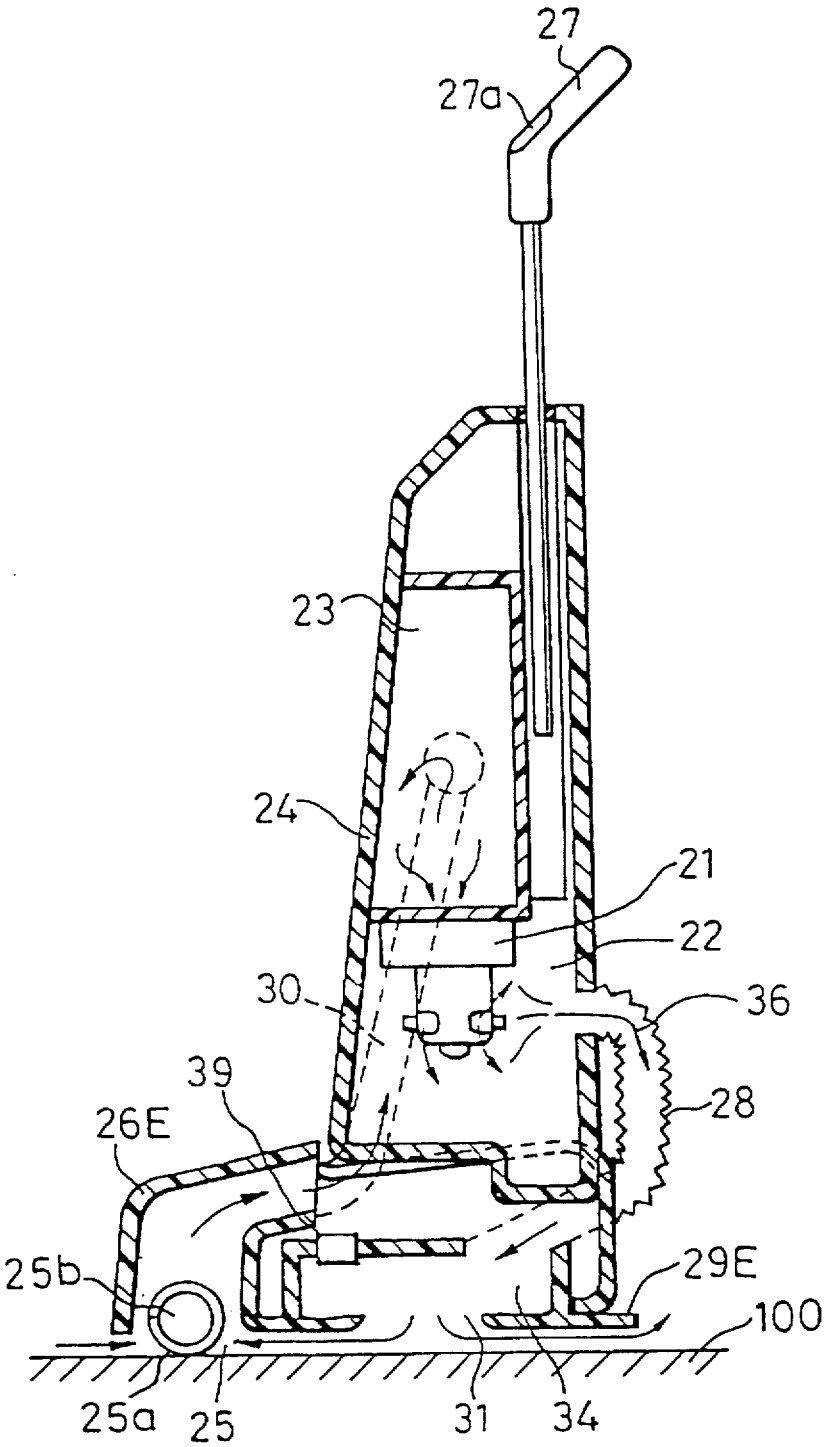
FIG. 10 is a sectional side view of a seventh embodiment of the upright vacuum cleaner in accordance with the present invention.

A seventh embodiment of the present invention is described with reference to FIG. 10. FIG. 10 shows a sectional side view of the upright vacuum cleaner of the seventh embodiment.

Corresponding parts and components to the first embodiment are shown by the same numerals and marks, and the description thereof made in the first embodiment similarly applies. Differences and features of this seventh embodiment from the first embodiment are as follows.

The upright vacuum cleaner of the seventh embodiment has a pressure-regulating valve 39, which is provided in an air chamber 34. The pressure-regulating valve 39 is provided for controlling the pressure of the discharge air 36 so as to keep under the predetermined safe pressure.

The construction and the operation of the pressure-regulating valve 39 in the seventh embodiment is substantially the same as the aforementioned pressureregulating valve 38 of the sixth embodiment. Therefore, the explanation of the pressure-regulating valve 39 of the seventh embodiment is omitted from the following explanation. Differences of the seventh embodiment from the sixth embodiment are as follows.

In the aforementioned sixth embodiment, since the pressure-regulating valve 38 is arranged in the main body 24 adjacent to the motor fan 21, the pressure-regulating valve 38 is liable to be influenced by the dynamic pressure of the discharge air 36. Therefore, it would be difficult to control the float force to maintain it at a constant level because the upright vacuum cleaner of the sixth embodiment would likely receive large pressure fluctuations in the motor fan chamber 22.

In the seventh embodiment, however, the pressure-regulating valve 39 is arranged in the air chamber 34, which is adjacent to the discharge-air outlet port 31, and which resists the influence of the dynamic pressure in the discharge air 36. As a result, the upright vacuum cleaner of the seventh embodiment receives only very small pressure fluctuations. And, the float force is easily and accurately controlled to a very constant one by the upright vacuum cleaner of the seventh embodiment.

According to the seventh embodiment, the vibration of the float plate 29E of the upright vacuum cleaner can be prevented for any kinds of floors to be cleaned.

[Eighth embodiment]

Figure 11:
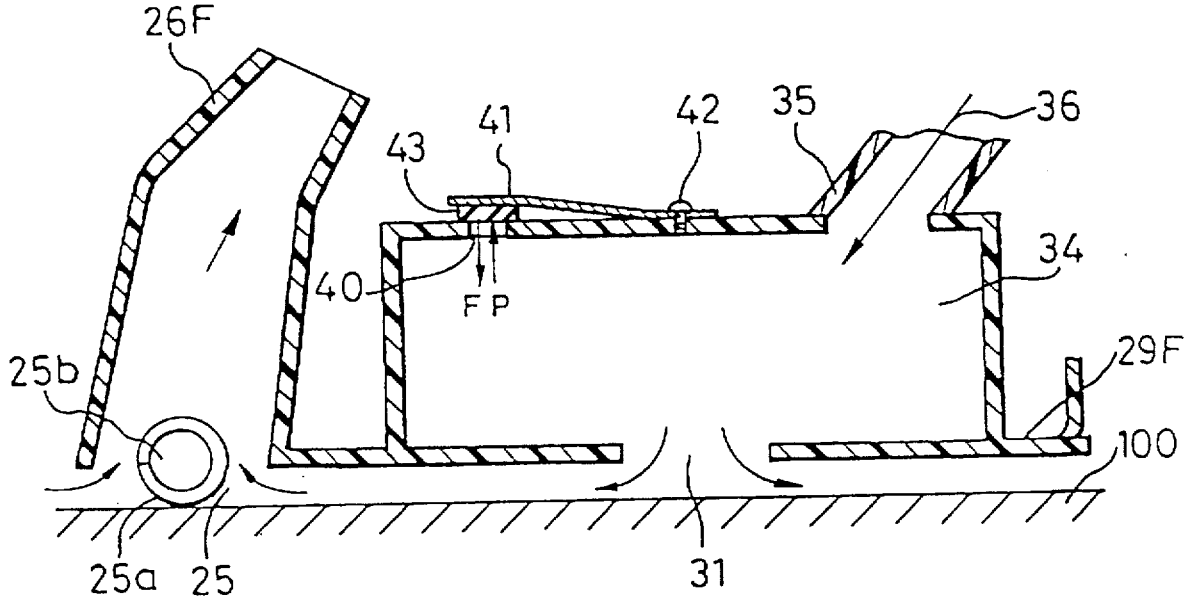
FIG. 11 is a sectional side view showing a part of an eighth embodiment of the upright vacuum cleaner in accordance with the present invention.

An eighth embodiment of the present invention is described with reference to FIG. 11. FIG. 11 shows a sectional side view of a floor nozzle unit 26F of an upright vacuum cleaner of the eighth embodiment.

Corresponding parts and components to the first embodiment are shown by the same numerals and marks, and the description thereof made in the first embodiment similarly applies. Differences and features of this eighth embodiment from the first embodiment are as follows.

In FIG. 11, an air chamber 34 of the floor nozzle 10 unit 26F has an air pit 40. The air pit 40 is opened and closed by a packing 43, which is fixed to an end of an elastic plate 41 for moving the packing 43. The other end of the elastic plate 41 is fixed to the upper wall of the air chamber 34 by a bolt 42. The packing 43 is held in a first position against the air pit 40 by a restoring force (shown with arrow F in FIG. 11) of the elastic plate 41. And, the elastic plate 41 is subjected to the pressure (shown with an arrow P in FIG. 11) in the air chamber 34 through the packing 43.

Operation of the above-mentioned eighth embodiment is elucidated hereafter.

In ordinary circumstances, the packing 43 is depressed to close the air pit 40 by the elastic plate 41, thereby spouting the discharge air from a discharge-air outlet port 31 only. In the above-mentioned circumstances, when the upright vacuum cleaner of the eighth embodiment is used for cleaning a flooring or a tatami mat etc., the discharge-air outlet port 31 is likely to be fairly closed. Then, the pressure P in the air chamber 34 gradually increases. As a result, the pressure P in the air chamber 34 becomes larger than the restoring force F of the elastic plate 41, thereby pushing up the elastic plate 41. When a gap is produced between the packing 43 and the air pit 40, the pressure P in the air chamber 34 decreases. And, the size of the gap is kept at well-balanced positioned between the pressure P and the restoring force F. Therefore, the pressure P in the air chamber 34 is kept at a constant desired value or less, that is less than the restoring force F. When the restoring force F is designed to set at a value less than a pressure which produces the vibration of the float plate 29F, vibration of the float plate 29F of the upright vacuum cleaner of the eighth embodiment due to the discharge air 36 is prevented.

According to the eighth embodiment, the vibration of the float plate 29F of the upright vacuum cleaner can be prevented by using only a simple and lowcost construction.

[Ninth embodiment]

Figure 12:
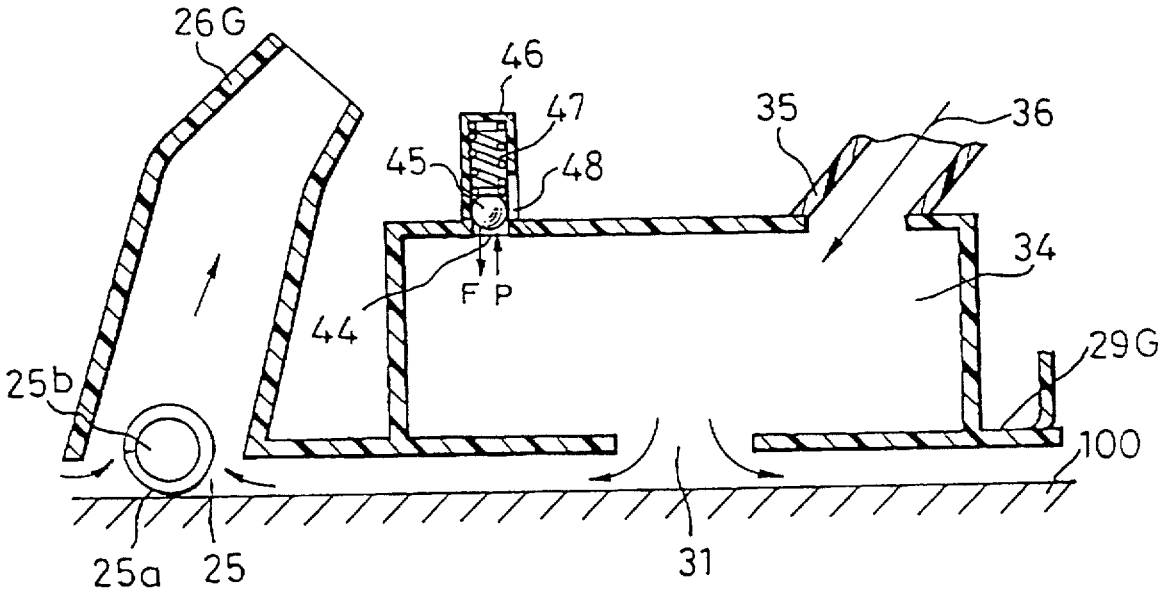
FIG. 12 is a sectional side view showing a part of a ninth embodiment of the upright vacuum cleaner in accordance with the present invention, FIG. 13 Is a sectional side view showing a part of a tenth embodiment of the upright vacuum cleaner in accordance with the present invention.

A ninth embodiment of the present invention is described with reference to FIG. 12. FIG. 12 shows a sectional side view of a floor nozzle unit 26G of an upright vacuum cleaner of the ninth embodiment.

Corresponding parts and components to the first embodiment are shown by the same numerals and marks, and the description thereof made in the first embodiment similarly applies. Differences and features of this ninth embodiment from the first embodiment are as follows.

In FIG. 12, an air chamber 34 of the floor nozzle unit 26G has an air pit 44. The air pit 44 is opened and closed by a stopper ball 45, which is guided by a guide cylinder 46. The guide cylinder 46 is fixed to the upper wall of the air chamber 34, and the stopper ball 45 slides vertically in the guide cylinder 46. The guide cylinder 46 has an opening 48 on a side face thereof. The stopper ball 45 is depressed to the air pit 44 by restoring force (shown with an arrow F in FIG. 12) of an elastic coil 47, such as a coil spring. And, the elastic coil 47 receives the pressure (shown with an arrow P in FIG. 12) of air in the air chamber 34 through the stopper ball 45.

Operation of the above-mentioned ninth embodiment is elucidated hereafter.

In ordinary circumstances, the stopper ball 45 is depressed to close the air pit 44 by the elastic coil 47, thereby spouting the discharge air from a discharge air outlet port 31 only. In the above-mentioned condition, when the upright vacuum cleaner is used for cleaning a flooring or a tatami mat etc., the discharge air outlet port 31 is likely to be fairly closed, and the pressure P of the air chamber 34 gradually increases. As a result, the pressure P in the air chamber 34 becomes larger than the restoring force F of the elastic coil 47, thereby pushing up the stopper ball 45. When the stopper ball 45 is pushed up by the pressure P, the air pit 44 of the air chamber 34 is connected to the opening 48 so as to discharge the air in the air chamber 34 from the opening 48. Then, the pressure P in the air chamber 34 decreases, and thereby the size of the opening 48 is kept at well balanced positioned between the pressure P and the restoring force F. Therefore, the pressure P in the air chamber 34 is kept at no greater than a constant value or less, that is less than the restoring force F. When the restoring force F is designed to set at a value less than a pressure which produces the vibration of the float plate 29G, the float plate 29G is prevented from vibration owing to the discharge air 36.

According to the ninth embodiment, the vibration of the float plate 29G of the upright vacuum cleaner can be prevented by only a simple and low-cost construction.

[Tenth embodiment]

Figure 13:
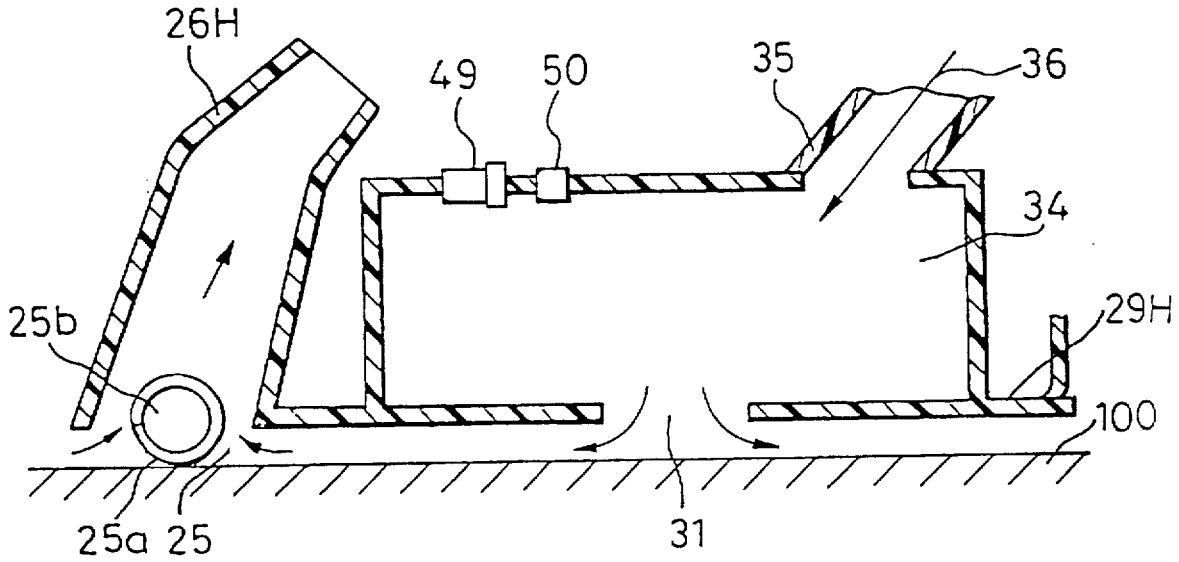

A tenth embodiment of the present invention is described with reference to FIG. 13. FIG. 13 shows a sectional side view of a floor nozzle unit 26H of an upright vacuum cleaner of the tenth embodiment.

Corresponding parts and components to the first embodiment are shown by the same numerals and marks, and the description thereof made in the first embodiment similarly applies. Differences and features of this tenth embodiment from the first embodiment are as follows.

In FIG. 13, a solenoid valve 49 is provided on an air chamber 34 of the floor nozzle unit 26H, and the air chamber 34 has a pressure sensor 50 for detecting a pressure P in the air chamber 34.

Operation of the above-mentioned tenth embodiment is elucidated hereafter.

In ordinary circumstances, the solenoid valve 49 is normally closed, thereby spouting the discharge air from the discharge-air outlet port 31 only. In the above-mentioned circumstances, when the upright vacuum cleaner of the tenth embodiment is used for cleaning a flooring or a tatami mat etc., the discharge-air outlet port 31 is likely to be fairly closed. Then, the pressure P in the air chamber 34 gradually increases. At the same time, the pressure P in the air chamber 34 is detected by the pressure sensor 50. If the detected pressure P becomes larger than a predetermined set value, a control circuit (not shown) makes the solenoid valve 49 change to an open state thereby discharging the pressurized air of the air chamber 34 through the solenoid valve 49. As a result, the pressure P in the air chamber 34 gradually decreases, and is kept at a value less than a desired pressure which is previously set in the control circuit. When a pressure of the discharge air is designed to set at a value less than a predetermined value which produces the vibration of the float plate 29H, the float plate 29H of the upright vacuum cleaner is prevented from the vibration owing to the discharge air.

In the tenth embodiment, since the float force is controlled by directly detecting the pressure of the air chamber 34 with the pressure sensor 50, the upright vacuum cleaner can accurately adjust the float force in comparison with the pressure-regulating value in the aforementioned embodiments. In case of slight fluctuation of the pressure in the air chamber 34, the upright vacuum cleaner can control smoothly the float force by using a micro-computer in the control circuit.

According to the tenth embodiment, the upright vacuum cleaner can accurately adjust the float force, and can be moved smoothly and lightly for of any type of flooring to be cleaned.

[Eleventh embodiment]

Figure 14:
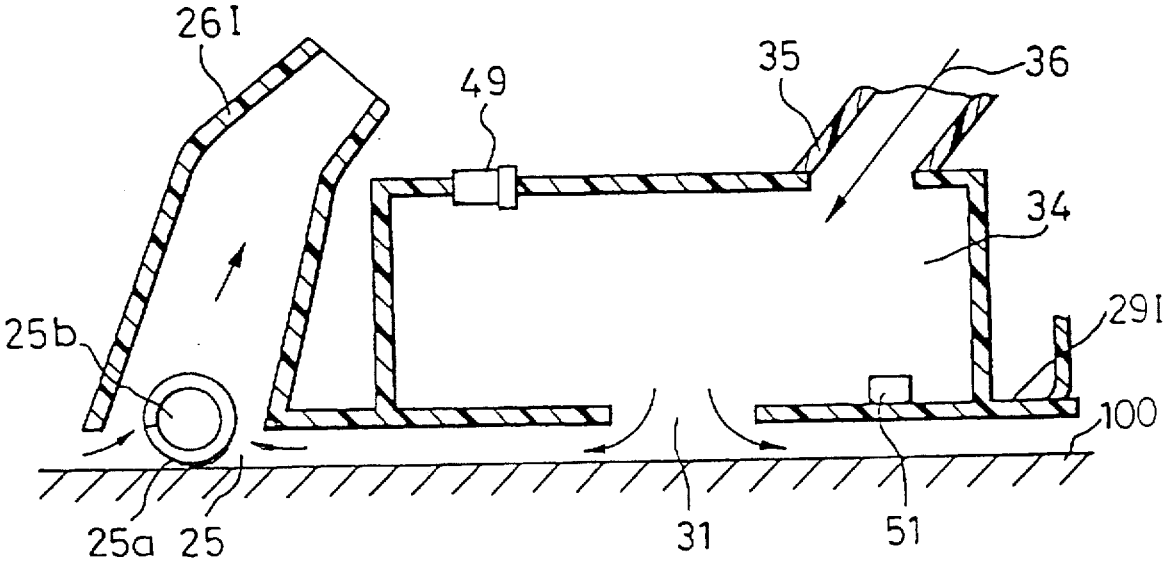
FIG. 14 is a sectional side view showing a part of an eleventh embodiment of the upright vacuum cleaner in accordance with the present invention.

An eleventh embodiment of the present invention is described with reference to FIG. 14. FIG. 14 shows a sectional side view of a floor nozzle unit 26I of an upright vacuum cleaner of the eleventh embodiment.

Corresponding parts and components to the first embodiment are shown by the same numerals and marks, and the description thereof made in the first embodiment similarly applies. Differences and features of this eleventh embodiment from the first embodiment are as follows.

In FIG. 14, a solenoid valve 49 is provided on an air chamber 34 of the floor nozzle unit 26I so as to close or open the air chamber 34. And, the air chamber 34 has a vibration sensor 51 for detecting a vibration of a float plate 29I of the floor nozzle unit 26I.

Operation of the above-mentioned eleventh embodiment is elucidated hereafter.

In ordinary circumstances, the solenoid valve 49 is normally closed, thereby spouting the discharge air from a discharge-air outlet port 31 only. In the above-mentioned circumstances, when the upright vacuum cleaner of the eleventh embodiment is used for cleaning a flooring or a tatami mat etc., the discharge-air outlet port 31 is likely to be fairly closed. Then, the pressure in the air chamber 34 gradually increases, and the float plate 29I is vibrated by discharging the pressurized air of the air chamber 34. When the float plate 29I is vibrated in a cleaning operation, the vibration of the float plate 29I is detected by the vibration sensor 51. If the detected vibration becomes larger than the predetermined set value, a control circuit makes the solenoid valve 49 change to an open state, thereby discharging the pressurized air of the air chamber 34 through the solenoid valve 49. As a result, the pressure In the air chamber 34 is decreased, and the vibration of the float plate 29I is reduced. When the vibration of the float plate 29I is less than the predetermined set value, the control circuit makes the solenoid valve 49 change to an close state. As mentioned above, the upright vacuum cleaner of the eleventh embodiment controls the float force by directly detecting the vibration, and the vibration of the float plate 29I is prevented by the discharge-air regulating unit having the solenoid valve 49 and vibration sensor 51 etc.

In the eleventh embodiment, since the vibration is directly detected by the vibration sensor 51, the vibration state of the float plate 29I can be accurately determined. Therefore, the float force can be accurately and appropriately controlled in the eleventh embodiment. And, vibration generated by the other cause than the fluctuation in the float force can be distinguished from the vibration owing to the float force by a control circuit using a micro-computer, thereby enabling elimination of a malfunction in the upright vacuum cleaner of the eleventh embodiment.

[Twelfth embodiment]

Figure 15:
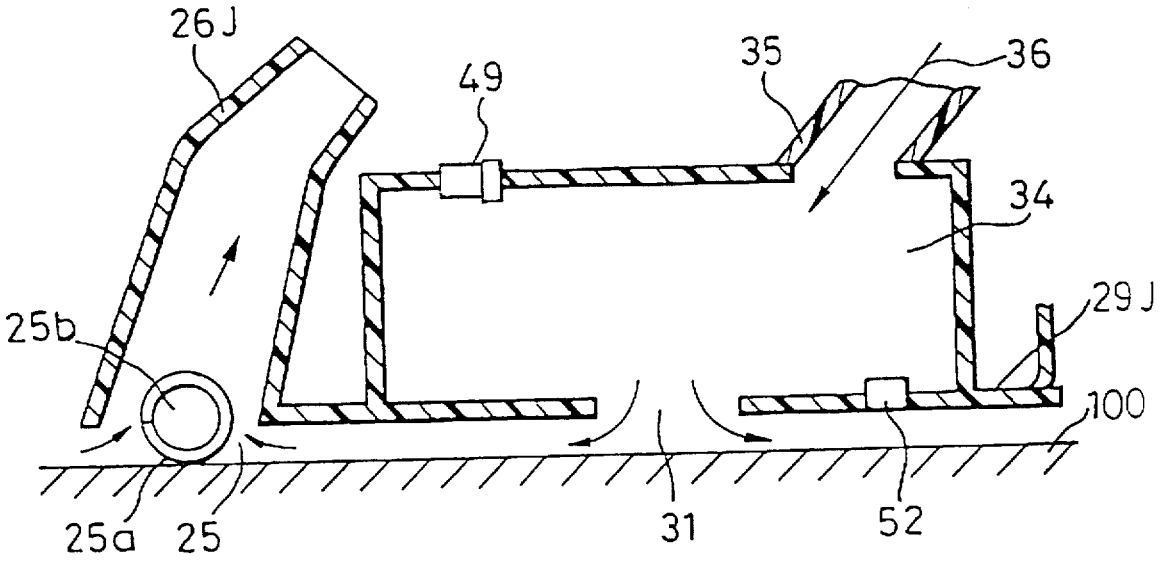
FIG. 15 is a sectional side view showing a part of a twelfth embodiment of the upright vacuum cleaner in accordance with the present invention.

A twelfth embodiment of the present invention is described with reference to FIG. 15. FIG. 15 shows a sectional side view of a floor nozzle unit 26J of an upright vacuum cleaner of the twelfth embodiment.

Corresponding parts and components to the first embodiment are shown by the same numerals and marks, and the description thereof made in the first embodiment similarly applies. Differences and features of this twelfth embodiment from the first embodiment are as follows.

In FIG. 15, a solenoid valve 49 is provided on an air chamber 34 of the floor nozzle unit 26J, so as to close or open the air chamber 34. And, the air chamber 34 has a range finder 52 for measuring the distance between the float plate 29J and the floor 100 to be cleaned.

Operation of the above-mentioned twelfth embodiment is elucidated hereafter.

In ordinary circumstances, the solenoid valve 49 is normally closed, thereby spouting the discharge air from a discharge-air outlet port 31 only. In the above-mentioned circumstances, when the upright vacuum cleaner of the twelfth embodiment is used for cleaning a flooring or a tatami mat etc., the discharge-air outlet port 31 is likely to be fairly closed. Then, the pressure in the air chamber 34 gradually increases, and the float plate 29J is vibrated by discharging the pressurized air of the air chamber 34. When the float plate 29J is vibrated in a cleaning operation, the vertical interval between the float plate 29J and the floor 100 changes within a short period. At the same time, the interval change is detected by the range finder 52. If the detected interval change becomes larger than a predetermined set interval, and when the period becomes shorter than a predetermined set period, a control circuit makes the solenoid valve 49 change to an open state, thereby discharging the pressurized air of the air chamber 34 through the solenoid valve 49. As a result, the pressure in the air chamber 34 decreases, and the vibration of the float plate 29J reduces. When the vibration of the float plate 29J becomes less than a predetermined set value, the control circuit makes the solenoid valve 49 change to a closed state. As mentioned above, the upright vacuum cleaner of the twelfth embodiment controls the float force by using the range finder 52, and the float plate 29J is prevented from vibration due to the discharge air.

In the twelfth embodiment, the vibration is detected by using the range finder 52, which measures the vertical interval change between the float plate 29J and the floor 100, and the period of the vibration. Therefore, the vibration state of the float plate 29J can be accurately detected, and the float force can be accurately and appropriately controlled in the twelfth embodiment. And, vibration generated by sources other than the fluctuation in the float force can be distinguished from the vibration owing to the float force by a control circuit using a micro-computer, thereby enabling elimination of a malfunction in the upright vacuum cleaner of the twelfth embodiment.

[Thirteenth embodiment]

Figure 16:
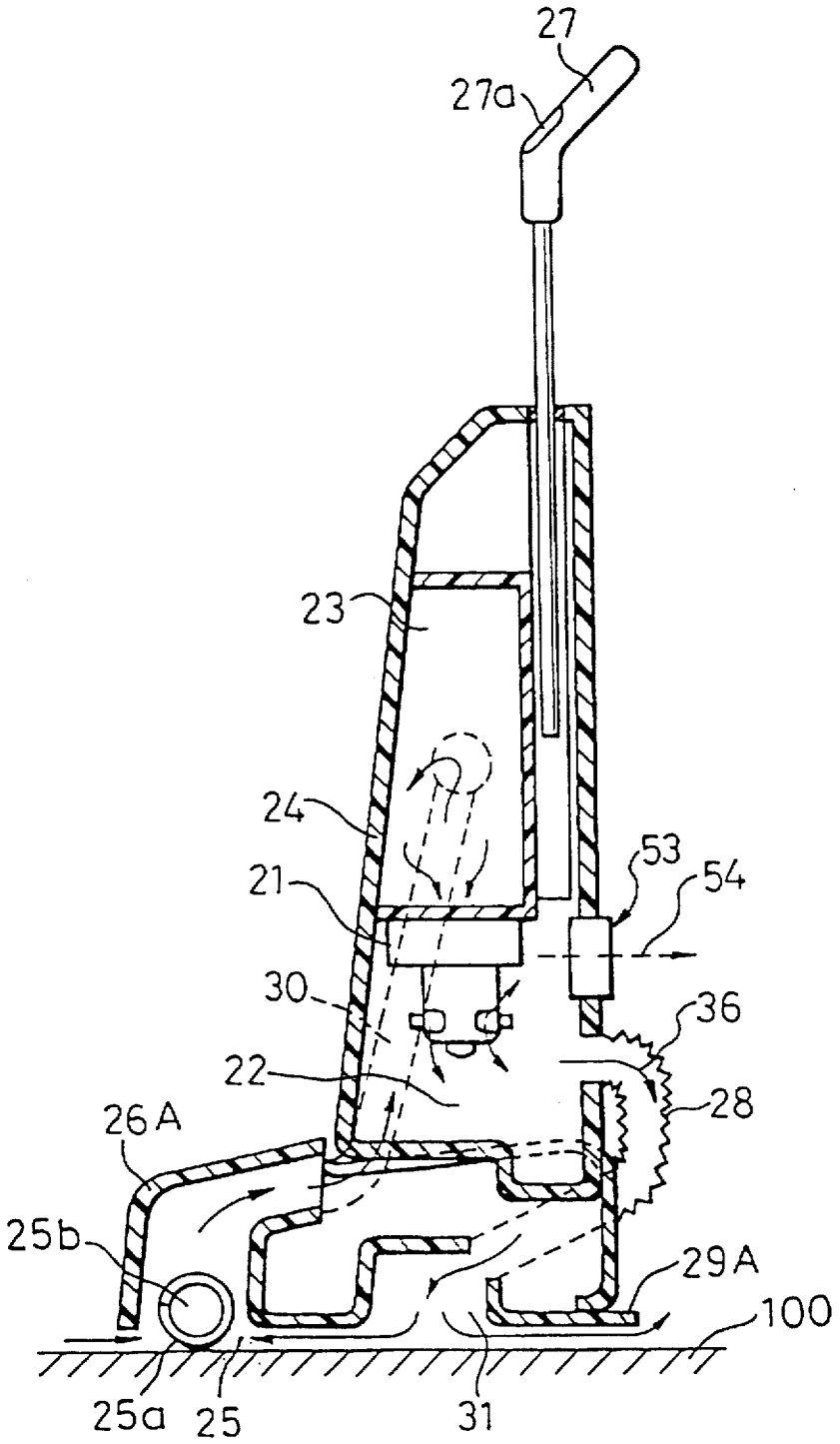
FIG. 16 is a sectional side view showing a thirteenth embodiment of the upright vacuum cleaner in accordance with the present invention.

A thirteenth embodiment of the present invention is described with reference to FIG. 16. FIG. 16 shows a sectional side view of an upright vacuum cleaner of the thirteenth embodiment.

Corresponding parts and components to the first embodiment are shown by the same numerals and marks, and the description thereof made in the first embodiment similarly applies. Differences and features of this thirteenth embodiment from the first embodiment are as follows.

In FIG. 16, an adjusting unit 53 is provided for regulating the amount of the second discharge air 54, which is discharging from a motor fan chamber 22 to the outside through the adjusting unit 53. The amount of flow of first discharge air 36 led to the discharge-air outlet port 31 is controlled by operating the adjusting unit 53.

Operation of the above-mentioned thirteenth embodiment is elucidated hereafter.

When the second discharge air 54 is set to discharge only a slight amount of air from the air chamber 22, plenty of the first discharge air 36 is spouted from the discharge-air outlet port 31, thereby increasing the float force. When the second discharge air 54 is set to discharge a greater amount of air from the air chamber 22, the amount of the first discharge air 36 led to the discharge-air outlet port 31 is reduced, thereby decreasing the float force.

As mentioned above, the float force for lifting the upright vacuum cleaner can be adjusted as users like. When the float plate 29A is vibrated owing to cleaning for different kinds of floors, the float force can be adjusted by setting the adjusting unit 53 in response to change of the circumstances, and the vibration of the float plate 29A is prevented by easily adjusting operation.

[Fourteenth embodiment]

Figure 17A:
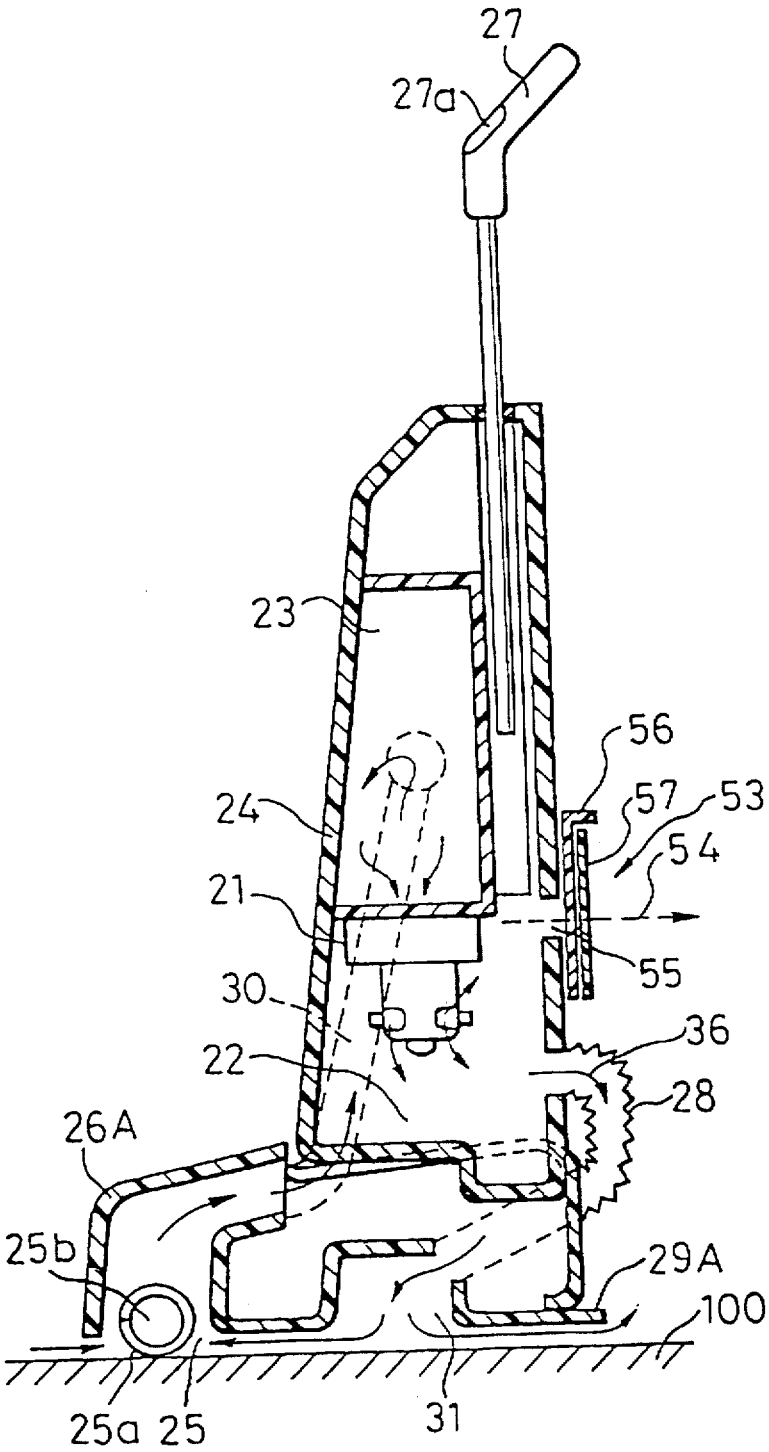
FIG. 17A is a sectional side view showing a fourteenth embodiment of the upright vacuum cleaner in accordance with the present invention.
Figure 17B:
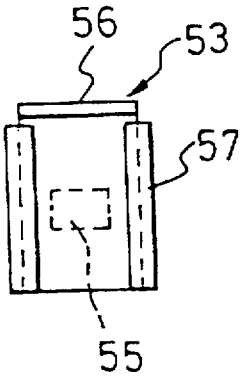
FIG. 17B is a rear view showing an adjusting unit of the fourteenth embodiment of the upright vacuum cleaner of FIG. 17A.

A fourteenth embodiment of the present invention is described with reference to FIGS. 17A and 17B. FIG. 17A shows a sectional side view of an upright vacuum cleaner of the fourteenth embodiment. FIG. 17B shows a rear view of an adjusting unit 53 of an upright vacuum cleaner of the fourteenth embodiment.

Corresponding parts and components to the first embodiment are shown by the same numerals and marks, and the description thereof made in the first embodiment similarly applies. Differences and features of this fourteenth embodiment from the first embodiment are as follows.

In FIG. 17A, a motor fan chamber 22 has a second outlet port 55, which is closed airtight and opened by a sliding-door 56 of the adjusting unit 53. The sliding door 56, having a bent portion at upper end for using as a knob, is guided vertically by a slide guide 57.

Operation of the above-mentioned fourteenth embodiment is elucidated hereafter.

The amount of the second discharge air 54 leaking from the second outlet port 55 is changed by moving the sliding door 56 vertically, thereby changing the amount of the first discharge air 36 discharged through the discharge-air outlet port 31 of the float plate 29A. When the sliding door 56 is set such that the second discharge air 54 from the second outlet port 55 decreases, plenty of the first discharge air 36 is spouted from the discharge-air outlet port 31, thereby increasing the float force for lifting the upright vacuum cleaner. When the sliding door 56 is set that the second discharge air 54 from the second outlet port 55 increases, the amount of the first discharge air 36 led to the discharge air outlet port 31 is reduced, thereby decreasing the float force.

As mentioned above, the float force for lifting the upright vacuum cleaner constructed by a simple and low-cost mechanism can be adjusted as the users likes. When the float plate 29A is vibrated owing to cleaning for different kinds of floors, the float force can be adjusted by setting easily the adjusting unit 53 in response to changes of the cleaning conditions. And, the vibration of the float plate 29A is prevented by easily adjusting operation.

[Fifteenth embodiment]

Figure 18:
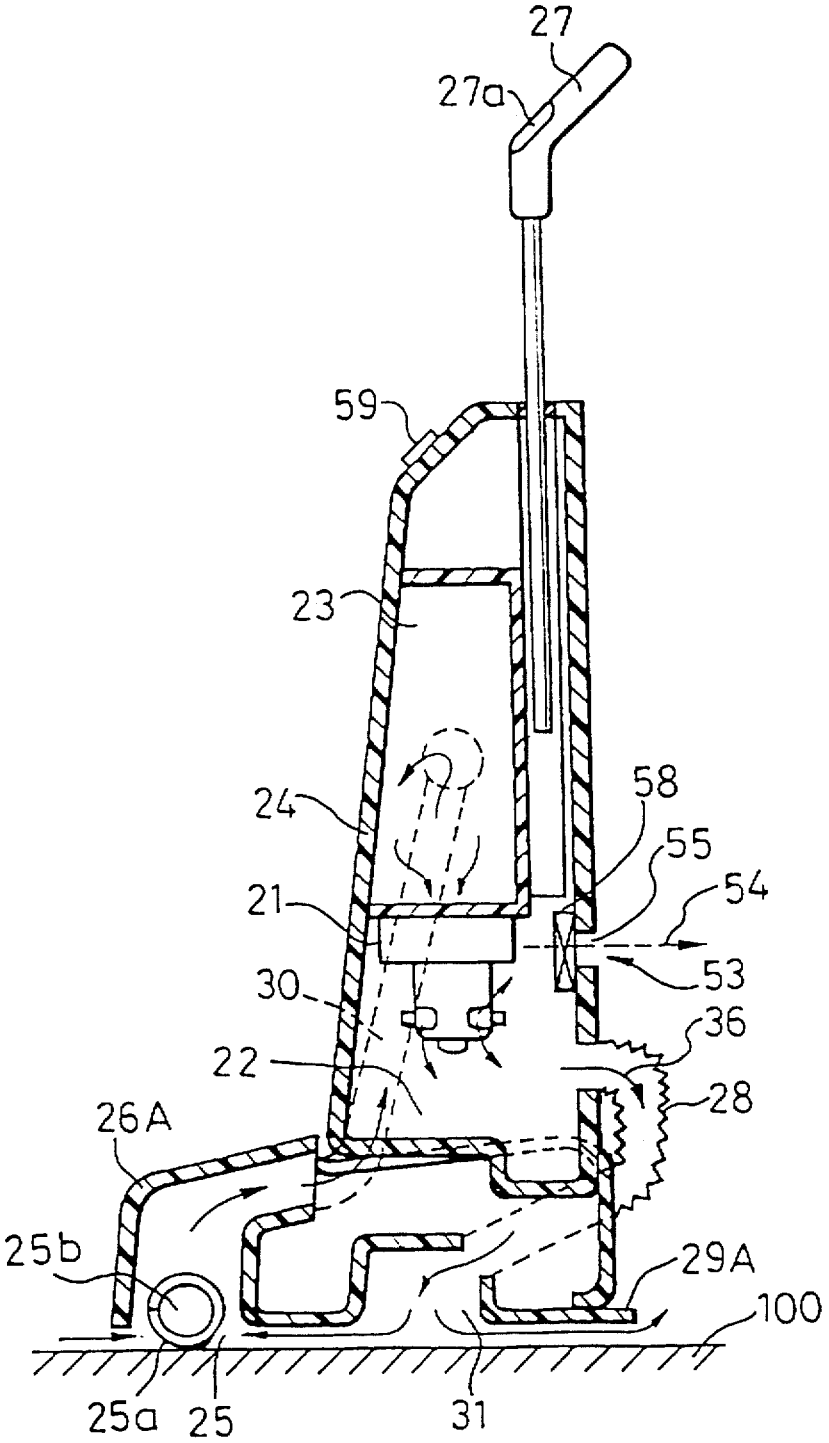
FIG. 18 is a sectional side view showing a fifteenth embodiment of the upright vacuum cleaner in accordance with the present invention.

A fifteenth embodiment of the present invention is described with reference to FIG. 18. FIG. 18 shows a sectional side view of an upright vacuum cleaner of the fifteenth embodiment.

Corresponding parts and components to the first embodiment are shown by the same numerals and marks, and the description thereof made in the first embodiment similarly applies. Differences and features of this fifteenth embodiment from the first embodiment are as follows.

In FIG. 18, a motor fan chamber 22 has a second outlet port 55, which is closed airtight and opened by an control unit 58 of an adjusting unit 53. The control unit 58 is actuated by an electrical switch 59 operated manually.

Operation of the above-mentioned fifteenth embodiment is elucidated hereafter.

When the electrical switch 59, which is disposed on the upper portion of a main body 24 of the upright vacuum cleaner, is actuated to output a control signal, a control circuit (not shown) operates the control unit 58 in response to the control signal. The amount of the second discharge air 54 leaking from the second outlet port 55 is changed by switching selectively the electrical switch 59, thereby changing the amount of the first discharge air 36 led to the discharge-air outlet port 31 of the float plate 29A. It is set that the second discharge air from the second outlet port 55 decreases, plenty of the first discharge air 36 is spouted from the discharge-air outlet port 31, thereby increasing the float force for lifting the upright vacuum cleaner. When it is set that the second discharge air 54 from the second outlet port 55 increases, the amount of the first discharge air 36 led to the discharge-air outlet port 31 is reduced, thereby decreasing the float force.

Since the electrical switch 59 can be disposed at any place on the main body 24, the electrical switch 59 can be arranged at a desirable position where the electrical switch 59 can be easily operated by a user.

[Sixteenth embodiment]

Figure 19:
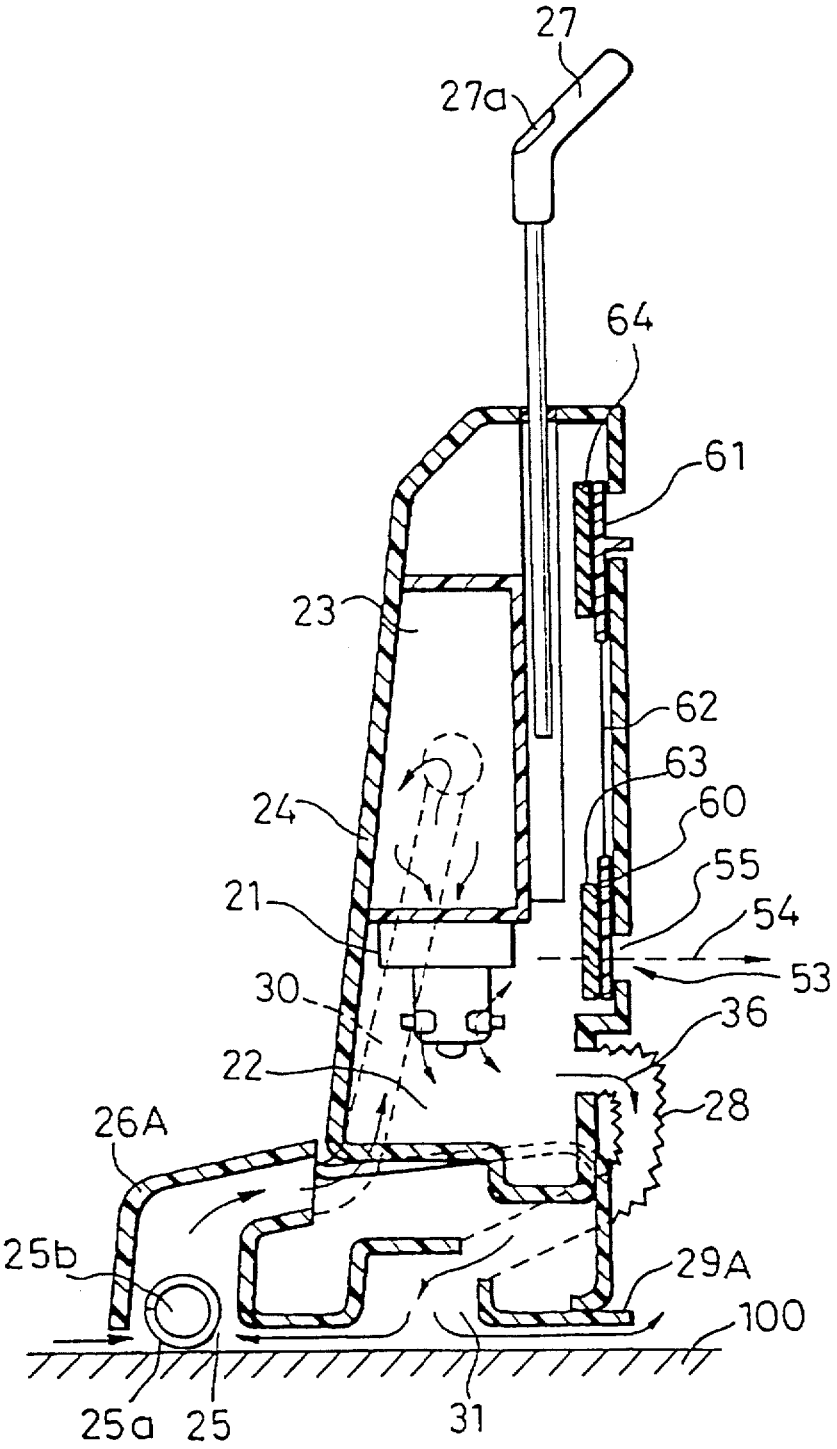
FIG. 19 is a sectional side view showing a sixteenth embodiment of the upright vacuum cleaner in accordance with the present invention.

A sixteenth embodiment of the present invention is described with reference to FIG. 19. FIG. 19 shows a sectional side view of an upright vacuum cleaner of the sixteenth embodiment.

Corresponding parts and components to the first embodiment are shown by the same numerals and marks, and the description thereof made in the first embodiment similarly applies. Differences and features of this sixteenth embodiment from the first embodiment are as follows.

In FIG. 19, a motor fan chamber 22 has a second outlet port 55, which is closed airtightly and opened by a control plate 60 of an adjusting unit 53. The control plate 60 is operated by a controller 61, which is disposed on the rear upper portion of a main body 24 of the upright vacuum cleaner. The controller 61 is mechanically connected to the control plate 60 through a connecting bar 62, such as a metal bar, for transmitting driving force for operating the control plate 60 vertically. The control plate 60 and the controller 61 are supported slidably by slide guides 63 and 64, respectively.

Operation of the above-mentioned sixteenth embodiment is elucidated hereafter.

When the controller 61 is slid vertically by a user, the control plate 60 is moved vertically because the control plate 60 is linked with the controller 61 through the connecting bar 62. The amount of the second discharge air 54 leaking from the second outlet port 55 is changed by sliding the control plate 60, thereby changing the amount of the first discharge air 36 led to the discharge air outlet port 31 of the float plate 29A. When the control plate 60 is set such that the second discharge air 54 from the second outlet port 55 decreases, plenty of the first discharge air 36 is spouted from the discharge-air outlet port 31, thereby increasing the float force for lifting the upright vacuum cleaner. When the control plate 60 is set such that the second discharge air 54 from the second outlet port 55 increases, the amount of the first discharge air 36 which is directed to the discharge-air outlet port 31 is reduced, thereby decreasing the float force.

In the above-mentioned upright vacuum cleaner of the sixteenth embodiment, the setting operation for a user is easily conducted by using the adjusting unit 53 having the control plate 60 and the controller 61 etc. constructed by a simple and low-cost mechanism.

[Seventeenth embodiment]

Figure 20:
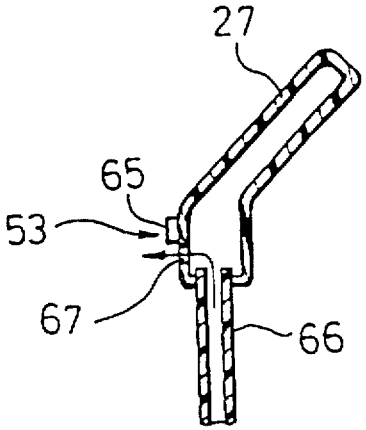
FIG. 20 is a sectional view showing a part of a seventeenth embodiment of the upright vacuum cleaner in accordance with the present invention.
Figure 21:
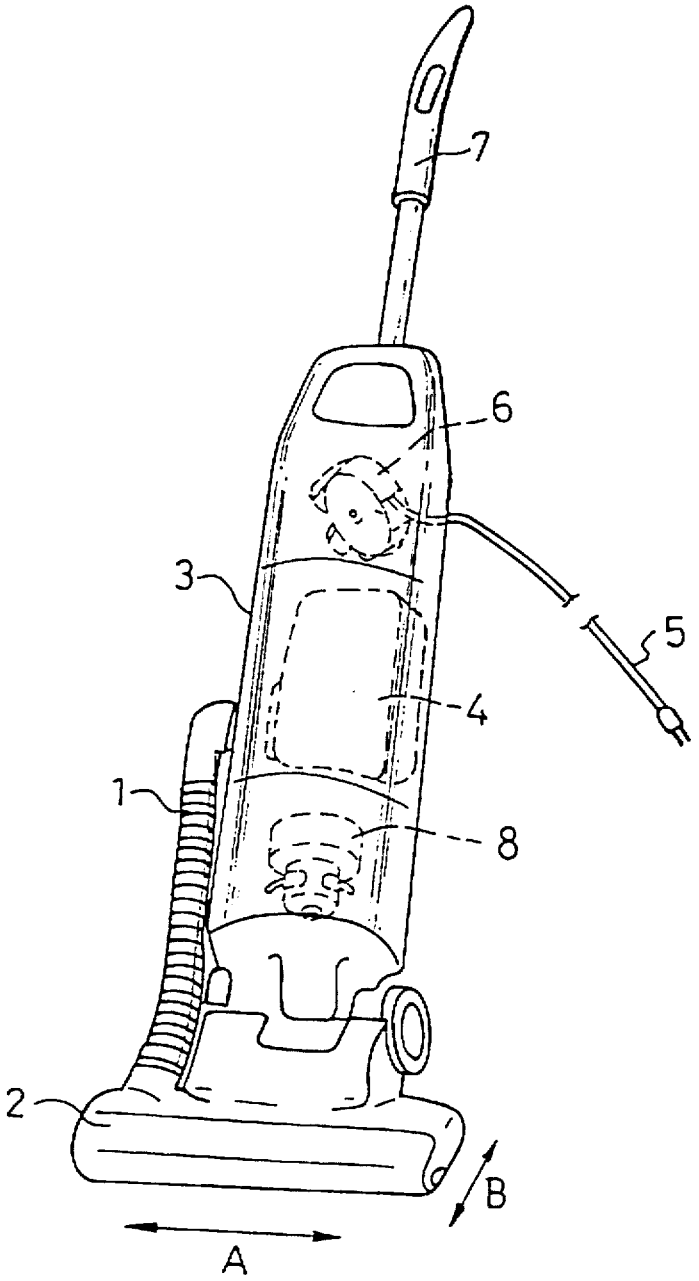
FIG.21 (Prior Art)
FIG. 21 is the perspective view showing the conventional upright vacuum cleaner.

A seventeenth embodiment of the present invention is described with reference to FIG. 20. FIG. 20 shows a sectional side view of a handle grip 27 of an upright vacuum cleaner of the seventeenth embodiment.

Corresponding parts and components to the first embodiment are shown by the same numerals and marks, and the description thereof made in the first embodiment similarly applies. Differences and features of this seventeenth embodiment from the first embodiment are as follows.

In FIG. 20, a controller 65 of an adjusting unit 53, which is disposed on the handle grip 27, is provided for controlling the float force of the upright vacuum cleaner. The handle grip 27 is connected to the main body of the upright vacuum cleaner through a handle 66 having a hollow-body.

In case of the operation as the aforementioned fourteenth embodiment shown in FIGS. 17A and 17B, the controller 65 is arranged to close and open a second outlet port 67, which is connected to a motor fan chamber through an inside of the handle 66. Therefore, the discharge air of the motor fan chamber is discharged from the second outlet port 67. And the amount of the discharge air is controlled by sliding the controller 65.

According to the upright vacuum cleaner of the seventeenth embodiment, the float force for lifting the upright vacuum cleaner can be controlled easily by operation on the handle grip 27.

Apart from the above-mentioned embodiment wherein the upright vacuum cleaner has the controller 65 for controlling the amount of the second discharge air leaking from the second outlet port 67 on the handle grip 27, a modified embodiment may be such that a control unit of the adjusting unit 53 used in the aforementioned fifteenth embodiment shown in FIG. 18 is provided in a handle grip of an upright vacuum cleaner. The control unit is provided for controlling the amount of a second discharge air leaking from a second outlet port on the handle grip. The adjusting unit 53 is easily constructed by electrically connecting between the control unit, an electrical switch and a control circuit.

And, in case of the operation as the aforementioned sixteenth embodiment shown in FIG. 19, an upright vacuum cleaner has a controller arranged on a handle grip 27. The controller moves a control plate through a connecting bar in a handle so as to control the amount of the second discharge air leaking from a second outlet port arranged in a main body of the upright vacuum cleaner.

In the upright vacuum cleaner of the seventeenth embodiment, since the adjusting unit 53, such as the controller 65 operated manually is arranged on the handle grip 27, a setting operation of a user can be easily conducted on the grip handle 27. And a user can quickly change the setting in response to the change of the circumstances in the cleaning operation.

In the aforementioned embodiments described from the six embodiment to the seventeenth embodiment, the upright vacuum cleaner has the motor fan 21 having a constant output. But apart therefrom, a modified embodiment may be such that an upright vacuum cleaner has an adjustable-output unit for controlling the rotation speed of the motor fan in proportion to the quantity of dust.

In case of the above-mentioned upright vacuum cleaner having the adjustable-output unit, when the output of the motor fan is set at a high-level by the adjustable output unit, the dust-collection capacity is heightened, and the pressure of the discharge air is also heightened by the high-power motor fan. As a result, the float plate is likely to vibrate owing to the high-pressurized discharge air. However, the vibration of the float plate can be reduced and the float force can be adjusted by using the adjusting unit described in the aforementioned embodiments. Therefore, the adjusting unit is useful in the upright vacuum cleaner, which Includes the motor fan having a variable suction force.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. An upright vacuum cleaner comprising:

a main body having a motor fan for generating a suction force, and a dust-collection chamber for collecting dust, the motor fan providing the suction force to the dust collection chamber, a floor nozzle unit, which is disposed under said main body, and has an inlet port connected to said dust-collection chamber for attracting dust on a floor into said dust-collection chamber by the suction force of said motor fan, a grip handle for moving said upright vacuum cleaner, and a float plate, disposed on a lower face of said floor nozzle unit, including a floor opposing face where a plurality of outlet ports are formed for spouting discharge air to said floor from said motor fan, and a float face is located around said outlet ports to receive a lifting force produced by pressure of the discharge air between said float face and the floor to be cleaned.

2. An upright vacuum cleaner in accordance with claim 1 wherein said outlet ports are arranged beneath a center of gravity of said vacuum cleaner.

3. An upright vacuum cleaner in accordance with claim 1 wherein said float unit has an air chamber, which is disposed at an outlet port side of a discharge air passage connecting between said outlet port and said motor fan in said main body.

* * * * *